US006651389B2

(12) United States Patent
Minter et al.

(10) Patent No.: US 6,651,389 B2
(45) Date of Patent: Nov. 25, 2003

(54) CASEMENT WINDOW WITH IMPROVED TIE BAR GUIDE AND STRIKER

(75) Inventors: Peter J. Minter, Branford, CT (US); John A. Chiaia, Branford, CT (US)

(73) Assignee: Roto Frank of America, Inc., Essex, CT (US)

( * ) Notice: Subject to any disclaimer, the term of this patent is extended or adjusted under 35 U.S.C. 154(b) by 211 days.

(21) Appl. No.: 09/742,741

(22) Filed: Dec. 21, 2000

(65) Prior Publication Data

US 2003/0070362 A1 Apr. 17, 2003

(51) Int. Cl.[7] ..... E05B 65/06

(52) U.S. Cl. ..... 49/394; 292/36; 292/302; 292/DIG. 33

(58) Field of Search ..... 49/394, 395; 292/8, 292/26, 36, 302, DIG. 33

(56) References Cited

U.S. PATENT DOCUMENTS

| | | | | | |
|---|---|---|---|---|---|
| 4,059,298 | A | | 11/1977 | Van Klompenburg | 292/199 |
| 4,429,910 | A | | 2/1984 | Anderson | 292/199 |
| 4,621,847 | A | | 11/1986 | Paulson et al. | 292/199 |
| 4,991,886 | A | | 2/1991 | Nolte et al. | 292/161 |
| 5,118,145 | A | | 6/1992 | Tucker | 292/158 |
| 5,318,333 | A | | 6/1994 | Dreifert | 292/336.3 |
| 5,370,428 | A | | 12/1994 | Dreifert et al. | 292/161 |
| D388,689 | S | | 1/1998 | Bauman et al. | D8/337 |
| D390,445 | S | | 2/1998 | Johnson et al. | D8/337 |
| 5,741,031 | A | | 4/1998 | Bauman et al. | 292/139 |
| 5,778,602 | A | | 7/1998 | Johnson et al. | 49/449 |
| 5,839,767 | A | | 11/1998 | Piltingsrud | 292/336.3 |
| 5,927,767 | A | * | 7/1999 | Smith et al. | 292/158 |
| 6,135,511 | A | * | 10/2000 | Smith et al. | 292/156 |
| 6,367,853 | B1 | * | 4/2002 | Briggs | 292/336.3 |

OTHER PUBLICATIONS

"Casement Operator and Multi Point Locking Bar for Vinyl and Aluminum Casement Windows," Wilhelm Weidtmann Gmbh & Co. KG Baubeschläge (2 pages).

* cited by examiner

*Primary Examiner*—Jerry Redman
(74) *Attorney, Agent, or Firm*—Marshall, Gerstein & Borun LLP

(57) ABSTRACT

An improved casement window is provided which includes a tie bar and at least two tie bar guides through which the tie bar slidably extends. The tie bar guides are secured to a window frame which includes an elongated groove that extends parallel to the tie bar. Each tie bar guide includes at least one locating leg that extends outward from the tie bar guide body and that is received in the groove of the window frame to assist in the easy location of the tie bar guide and tie bar along the window frame. Further, each tie bar guide may be equipped with a protruding nib that is received in an aperture disposed in the tie bar. The cooperation of the tie bar guide and the aperture of the tie bar ensures that the tie bar guide is properly spaced along the length of the tie bar. The nib is sheared off of the tie bar guide after the tie bar guide is secured to the window frame and the tie bar is moved axially through the guide. The tie bar guide may also include outwardly protruding ribs that provide structural support for the wood stop that overlays the tie bar, the tie bar guides and the window frame. Distal ends of the back wall of the tie bar guides may be tapered and supported by a ledge. The length of the tapered distal ends may be shortened to adjust the position of the tie bar guides with respect to the window frame. The roller of the tic bar may be eccentrically mounted to enable the position of the roller to be adjusted after the tie bar and tie bar guides are secured to the frame. An improved keeper is provided which can be more securely attached to the sash to prevent pull-out.

30 Claims, 4 Drawing Sheets

CASEMENT WINDOW WITH IMPROVED TIE BAR GUIDE AND STRIKER

FIELD OF THE INVENTION

The present invention relates generally to locking mechanisms for casement windows. More specifically, the present invention relates generally to tie bars for multi-point or sequential locking mechanisms for casement windows. Still more specifically, the present invention relates to an improved tie bar guide used to secure a tie bar to a frame of a casement window and which facilitates the placing of the tie bar and the tie bar guides along the frame of the window. The present invention also relates to an improved means for spacing tie bar guides along a casement window tie bar, an improved keeper design and a means for adjusting the positions of the rollers after installation of the tie bar.

BACKGROUND OF THE INVENTION

Casement windows are known. In the past, the locking of a casement window sash to a window frame has been problematic because casement window sashes have a tendency to warp with age and therefore it can be difficult to hold an entire side edge of a sash against a frame for locking purposes. Further, casement window operators typically apply the closing force to only one end of the casement window sash, e.g. the bottom end, and therefore there is a tendency for one end of the sash to engage the frame before the opposing end of the sash. As a result, the side edge of the sash that is to be locked against the frame does not engage the frame all at once thereby making the sash difficult to lock.

To overcome these problems, tie bars have been employed along the edge of the frame to lock the sash against the frame. The tie bars typically include a plurality of rollers mounted on the tie bar that engage ramped keepers spaced along the edge of the window sash. To address the warping problem discussed above, the rollers and keepers are appropriately spaced so that the rollers engage the keepers in a sequential manner, typically starting from the bottom of the sash and ending with the top of the sash. As a result, the bottom of the sash is locked first and the sequential interaction of the middle and top rollers with the middle and top keepers respectively results in the middle and top portions of the sash being pulled against the frame and locked shut.

However, due to the success and wide acceptance of such sequential locking mechanisms, these locking mechanisms are used in a variety of different windows having window frames and window sashes with a wide variety of dimensions and configurations. As a result, a single style of locking hardware is often installed on a wide variety of window frames. Therefore, the installer can often be confused as to the precise location of the tie bar and tie bar guides along the inside surface of the window frame. If the tie bar and tie bar guides are not installed properly, they must be removed and reinstalled which may result in the leaving of some unsightly holes along the inside surface of the window frame. Therefore, there is a need for an improved tie bar and tie bar guide system which facilitates the placement of the tie bar and tie bar guides along the inside surface of the window frame to ensure that the tie bar and tie bar guides are installed at the right location and at the right distance from the handle or actuator.

Another problem associated with the use of conventional tie bars and tie bar guides is the correct spacing of the tie bar guides along the tie bar. Specifically, as the tie bar slides through the tie bar guides, it is structurally important for the tie bar guides to be mounted to the inside surface of the window frame in an even, spaced-apart fashion. Further, because the tie bar guides slide over the tie bar, it is difficult for the installer to space the tie bar guides evenly apart as they are being secured to the window frame. Therefore, there is a need for an improved tie bar and tie bar guide combination which makes it easier to evenly space the tie bar guides along the tie bar and window frame.

Another problem associated with the use of conventional tie bars, rollers and keepers is the frequency in which the keepers may be pulled out of the window sash. Specifically, typical keepers are screwed into the sash with two screws disposed normal to the sash surface. Because the force imposed on the keeper by the rollers is predominantly in a direction normal to the sash surface, these prior art designs require the holding power of the screws in the window sash to hold the keeper in place. It has been found that these designs are prone to failure and that the screws holding the keepers in place can pull out of their respective holes in the sash surface. When this occurs, the repair is problematic because the position of the keepers should remain the same in order for proper sequential locking to take place. Hence, the keepers cannot be moved to locate fresh wood for new screw holes without upsetting the locking sequence. Therefore, there is a need for a striker design with improved sheer stress resistance.

Finally, the proper alignment of each roller with its respective keeper is important to facilitate the locking sequence with the least amount of force necessary. Often, adjustments of the position of either the tie bar or the keepers is necessary to facilitate the locking sequence. Accordingly, there is a need for a means for adjusting the position of the rollers with respect to the keepers without having to move the tie bar or the keepers.

Still further, another problem associated with casement window hardware involves the wood stop which overlies the tie bar, tie bar guides and the window frame. Specifically, there is a lack of structural support for the wood stop in the area along the tie bar. Because of this lack of structural support, wood stops are prone to breakage or cracking. Therefore, there is a need for an improved casement window locking system which provides extra structural support for the wood stop to prevent the frequent occurrences of breakage and cracking.

SUMMARY OF THE INVENTION

The present invention satisfies the aforenoted needs by providing an improved casement window which comprises a tie bar, at least one tie bar guide through which the tie bar slidably extends, a window frame which comprises an elongated groove that extends parallel to the tie bar and wherein the tie bar guide comprises a body and at least one locating leg that extends outward from the body. The locating leg is received in the groove of the frame. As a result, the combination of the groove disposed in the frame and the locating legs of the tie bar guide ensure that the tie bar and tie bar guides will be mounted to the window frame in the correct position. Further, with the locating legs disposed in the groove of a wood window, the tie bar guides can be adequately secured in place with a single screw as opposed to multiple screws.

In an embodiment, the tie bar guide further comprises a plurality of spaced apart locating legs, all of which are received in the groove of the frame.

In an embodiment, the groove disposed in the window frame is parallel to the tie bar.

In an embodiment, the tie bar guide comprises at least two locating legs with a through hole disposed therebetween for receiving a screw that is used to secure the tie bar guide to the window frame.

In an embodiment, the tie bar guide further comprises a back wall that abuttingly engages the frame. The back wall is connected to a U-shaped top which, in turn, connects the back wall to a front wall. The front and back walls each comprise bottom ends that abuttingly engage each other. The tie bar is slidably received in an aperture formed by the front wall, the rear wall, the U-shaped top and the abutting bottom ends of the front and rear walls. In such an embodiment, the at least one locating leg extends outward from the rear wall of the tie bar guide and into the groove of the window frame.

In an embodiment, the tie bar guide further comprises at least one rib that extends outward from the front wall. Further, the casement window also comprises a wood stop and the rib of the tie bar guide abuttingly engages and provides structural support for the wood stop.

In an embodiment, the tie bar guide further comprises a plurality of ribs that extend outward from the front wall to provide structural support for the wood stop.

In an embodiment, the bottom ends of the front and rear walls of the tie bar guide each comprise a through hole, the through holes of the front and rear walls are in alignment for receiving a screw for securing the tie bar guide to the frame.

In an embodiment, the tie bar comprises an aperture and the tie bar guide comprises a nib that is received in the aperture. After the tie bar guide is secured to the window frame, sliding movement of the tie bar through the tie bar guide will result in the nib being sheared off of the tie bar guide.

In an embodiment, the present invention provides an improved casement window that comprises a tie bar, at least two tie bar guides through which the tie bar slidably extends, a window frame to which the tie bar guide is secured and a wood stop which overlies the tie bar, the tie bar guide and the window frame. In such an embodiment, the tie bar guides each comprise a back wall that abuttingly engages the frame. The back wall of the tie bar guide is connected to a U-shaped top which connects the back wall to a front wall. The front and back walls of the tie bar guide each comprise bottom ends that abuttingly engage each other. The tie bar is slidably received in an aperture form by the front wall, the rear wall, the U-shaped top and the abutting bottom ends of the front and rear walls. The tie bar guide further comprises at least one rib that extends outward from the front wall and that abuttingly engages and provides structural support for the wood stop.

In an embodiment, the present invention provides an improved casement window that comprises a tie bar comprising an aperture and at least two tie bar guides through which the tie bar slidably extends. The tie bar guides each comprise a nib that is received in an aperture of the tie bar. As a result, an initial sliding movement of the tie bar through the tie bar guides as the tie bar guides are fixed in place will result in the nib being sheared off of the tie bar guide.

In an embodiment, the present invention provides a method of installing casement window hardware on a casement window frame. The method comprises the steps of providing a casement window frame with an elongated groove disposed therein, providing a tie bar and at least two tie bar guides through which the tie bar slidably extends and wherein the tie bar guides each comprise a body with at least one locating leg extending outward from the body, inserting the at least one locating leg into the groove of the frame and thereafter securing the tie bar guides to the frame.

In an embodiment, the present invention provides an improved method of installing tie bar guides on a tie bar in a predetermined spaced-apart fashion. The method of the present invention comprises the steps of providing a tie bar having first and second spaced-apart apertures therein, providing first and second tie bar guides through which the tie bar slidably extends and wherein the first and second tie bar guides comprise first and second nibs respectively that are received in the first and second apertures of the tie bar respectively, and placing the tie bar guides in a spaced-apart manner over the tie bar so that the tie bar extends through the tie bar guides and so that the first nib of the first tie bar guide is received in the first aperture of the tie bar and so that the second nib of the second tie bar guide is received in the second aperture of the tie bar.

In an embodiment, the method further comprises the steps of attaching each tie bar guide to a window frame and initially sliding the tie bar through the tie bar guides to shear off the first and second nibs from the first and second tie bar guides respectively.

In an embodiment, the present invention provides an improved keeper design which comprises an upper arm connected to a base in a C-shaped configuration. The base is connected to a lower supporting section that is accommodated in a slot disposed in the window sash. The keeper is preferably fabricated from flat plate-like material. Holes extend transversely through the lower supporting section for accommodating screws to secure the keeper in place. Thus, the screws extend transversely to outward sheer forces that are imposed on the upper arm. The transverse relationship between the screws and the sheer forces provides for improved sheer resistance.

In an embodiment, the base portion of the keeper includes front and rear projecting portions that engage the sash surface when the lower supporting portion is disposed below the sash surface and in the slot. The sash can be pre-routed to ensure proper location of the keepers as opposed to relying upon an assembler's physical measurement.

In an embodiment, the rollers that are connected to the tie bar of the present invention comprise a pin that is connected to the tie bar. The pin eccentrically extends through a roller and is connected to an outer plate so that the roller is trapped between the outer plate and the tie bar. The pin is fixedly connected to the outer plate. As noted above, the pin does not extend through a central access of the roller but, instead, extends through the roller in an eccentric fashion. The roller is tightly trapped between the outer plate and the tie bar and frictionally engages each component. The pin is tightly, but pivotally, connected to the tie bar. Accordingly, application of torque to the outer plate will cause the pin to rotate with respect to the tie bar and, consequently, will cause the roller to rotate with respect to the pin. As a result, the position of the roller vis a vis the tie bar can be adjusted by applying a torque to the outer plate. In an embodiment, the outer plate is shaped in such a manner so that a sufficient grip can be easily obtained with a pair of pliers.

Other objects and advantages of the present invention will become apparent to those skilled in the art upon reviewing the following detailed description, drawings and appended claims.

BRIEF DESCRIPTION OF THE DRAWINGS

For a more complete understanding of the present invention, reference should now be made to the embodiments illustrated in greater detail in the accompanying drawings and following detailed description of the presently preferred embodiments.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
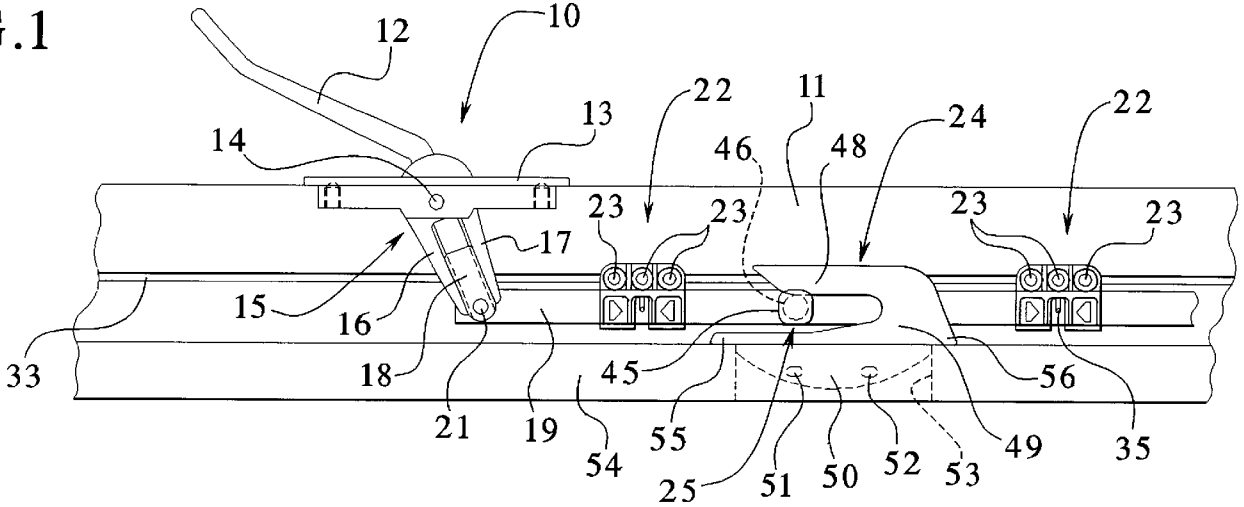
FIG. 1 is a side plan view of a casement window lock operator, tie bar, tie bar guides, roller and keeper installed on a window frame, the tie bar, tie bar guides, roller and keeper being made in accordance with the present invention.

Turning first to FIG. 1, a casement window lock operator 10 is shown as installed on a window frame 11. The operator 10 includes a handle 12 that is pivotally connected to an escutcheon 13 at a pin 14. The handle 12 is connected to a forked end 15 which includes legs 16, 17. Between the legs 16, 17 is received a slider 18. The slider 18 is pivotally connected to a tie bar 19 at a rivet 21 or other suitable connection means.

The tie bar 19 is slidably received in two tie bar guides shown at 22. The tie bar guides are secured to the frame 11 by a plurality of screws shown at 23. As will be discussed below, three screws 23 are not needed to secure the tie bar guide 22 against the frame 11 but in the design of the tie bar guide 22 illustrated in FIGS. 1–4, three screw holes are provided.

Also shown in FIG. 1 is a keeper 24 which is secured to the frame 11 and a cam 25 which is connected to the tie bar 19 and which engages the keeper 24 upon lateral movement of the tie bar 19.

Figure 4:
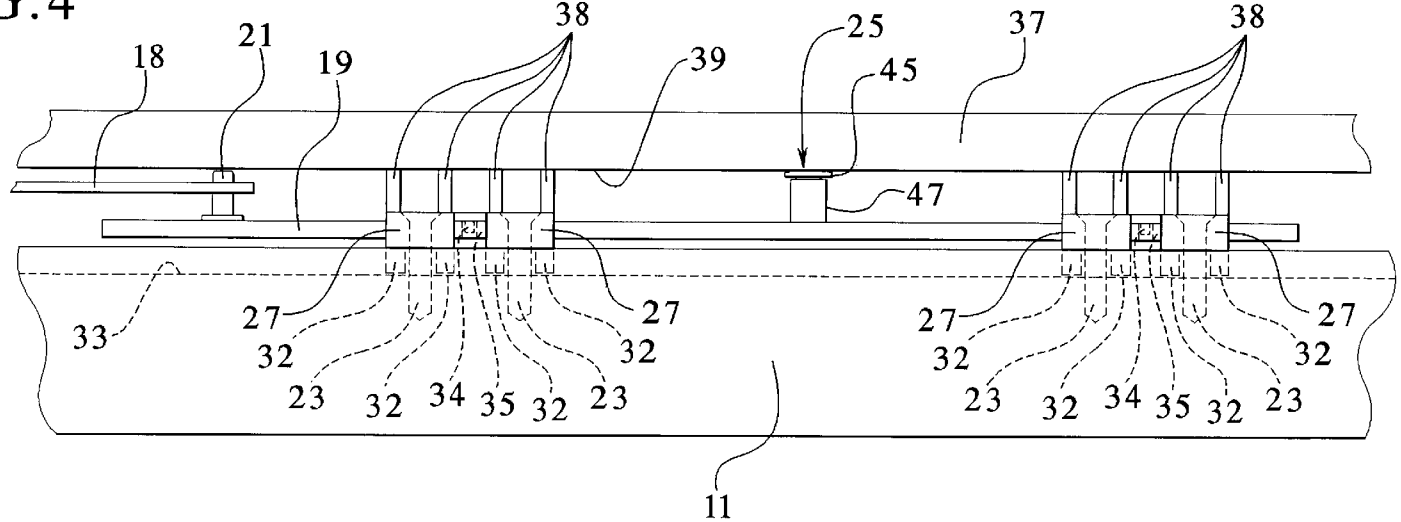
FIG. 4 is a plan view of a tie bar and two tie bar guides as installed between a wood stop and a casement window frame.
Figure 2:
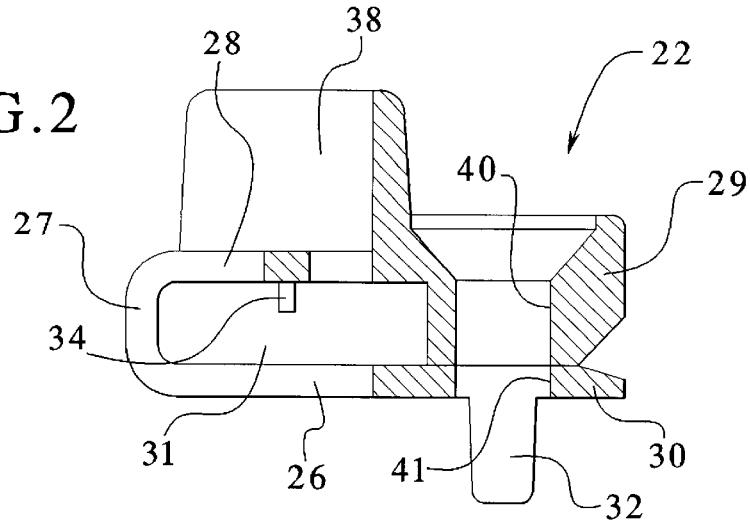
FIG. 2 is a side sectional view of a tie bar guide made in accordance with the present invention.
Figure 3:
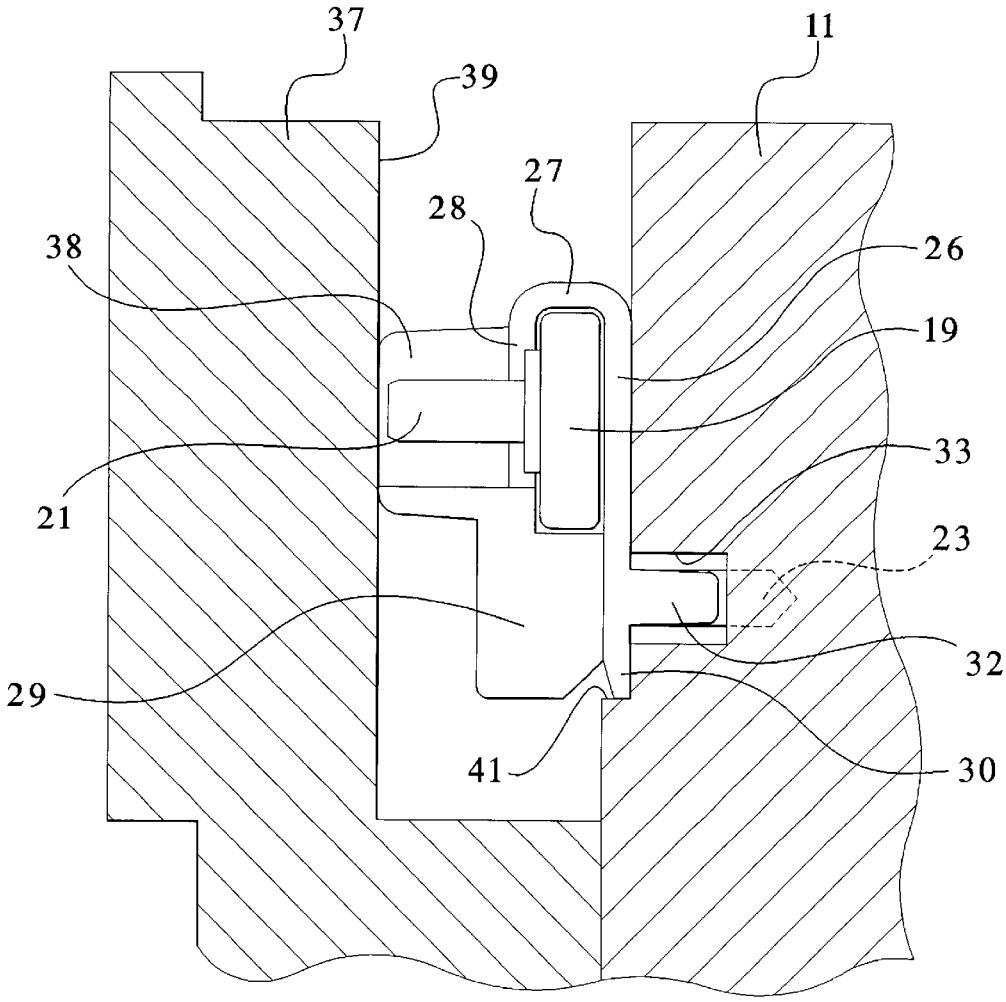
FIG. 3 is a side view of a tie bar and tie bar guide made in accordance with the present invention as installed between a window frame and wood stop.

The inventive tie bar guide 22 is further illustrated in FIGS. 2–4. Specifically, the tie bar guide 22 includes a back wall 26 which is connected to a U-shaped top 27 which, in turn, connects the back wall 26 to a front wall 28. The front wall 28 and back wall 26 each include distal ends 29, 30 respectively which abuttingly engage each other as shown in FIG. 2. As a result, an aperture 31 is formed by the back wall 26, U-shaped top 27, front wall 28 and abutting distal ends 29, 30 of the front wall 28 and back wall 26 respectively. The tie bar 19 is able to slide through the aperture 31.

Extending outward from the back wall 26 is at least one leg shown at 32 in FIG. 2 and the remainder of which is shown in phantom at 32 in FIG. 4. The locating legs 32 are received in the elongated groove 33 provided in the window frame 11 as shown in FIG. 1. By providing the combination of the groove 33 in the frame 11 and the locating legs 32 in the tie bar guides 22, an improved tie bar guide 22/tie bar 19 combination is provided whereby it is assured that the tie bar 19 and tie bar guides 22 will be installed on the window frame 11 in the correct position. No markings are required on the window frame 11; the groove 33 provides the correct distance between the tie bar guides 22, and therefore the tie bar 19, from the window operator 10. Accordingly, the locating legs 32 of the tie bar guide 22 of the present invention greatly facilitate the installation of the tie bar guides 22 and tie bar 19 on the window frame 11.

Figure 4A:
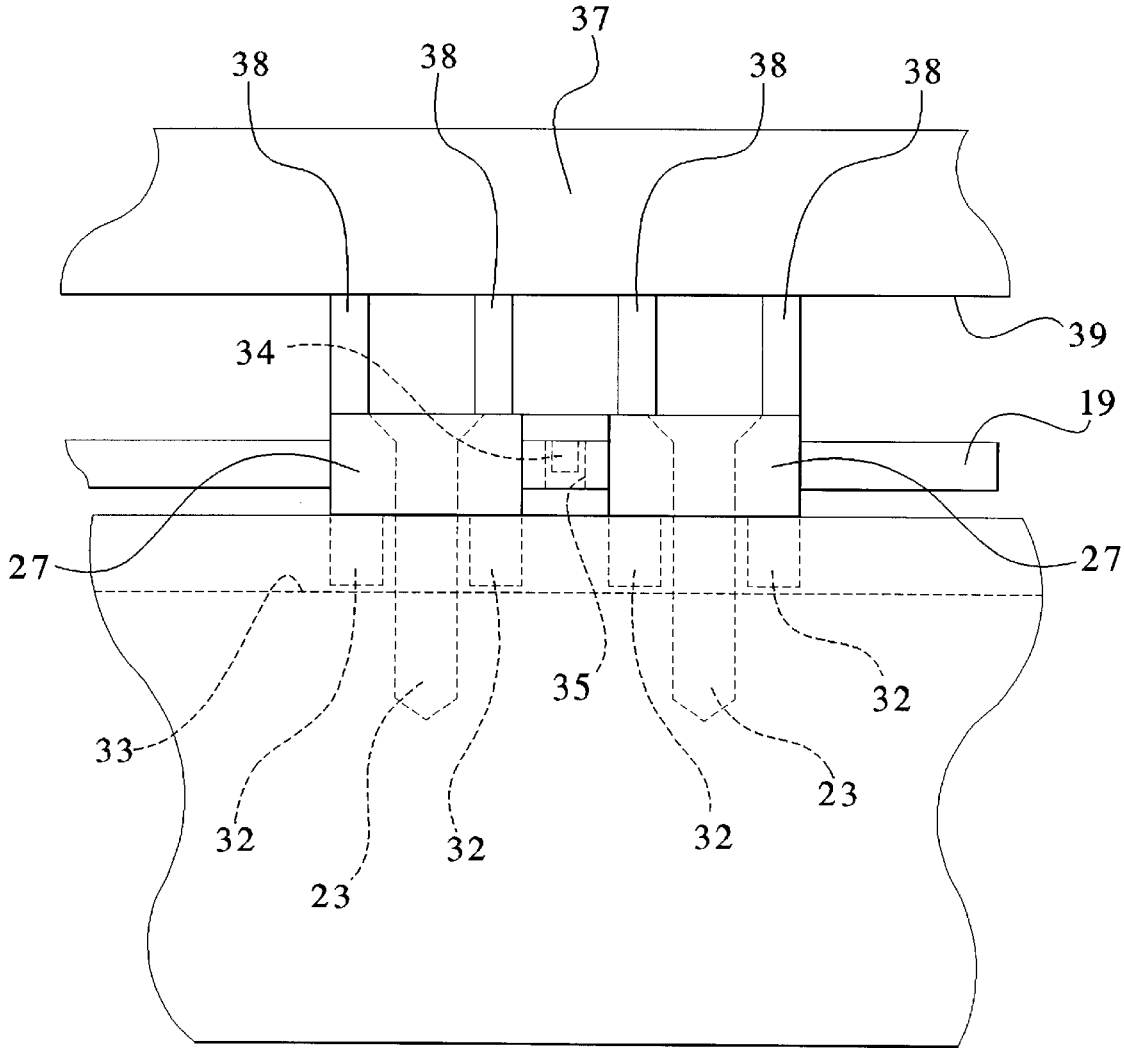
FIG. 4A is a partial enlarged view of the tie bar guide and tie bar shown in FIG. 4.

Another feature illustrated in FIG. 2 is the nib 34 that protrudes inwardly from the front wall 28 of the tie bar guide 22. The nib 34 is received in the aperture 35 disposed in the tie bar 19 as illustrated in FIG. 4. By providing the combination of a nib 34 on the tie bar guide 22 and an aperture 35 in the tic bar 19, the inventors have provided a simplified method for locating the tie bar guides 22 along the tie bar 19. Thus, the tie bar guides 22 can be easily spaced along the tie bar 19 in a predetermined spaced-apart fashion by providing the nibs 34 on the tie bar guides 22 and further by providing the apertures 35 in the tie bar 19 which receive the nibs 34. After the tie bar guides 22 are secured to the frame 11 with the screws 23, the tie bar 19 may be slid axially through the tie bar guides which will result in the nibs 34 being sheared off of the front wall 28 of the tie bar guide 22. Thus, the interaction of the nibs 34 and apertures 35 is for installation and initial alignment purposes only. After the tie bar guides 22 and tie bar 19 is installed and connected to an operator 10 and after the tie bar 19 is initially moved axially through the tie bar guides 22, the nibs 34 are easily sheared off by the axial movement of the tie bar 19. Accordingly, the present invention provides an improved means for achieving the correct spacing of the tie bar guides 22 along the tie bar 19. FIG. 4A is an enlarged, partial plan view which more easily illustrates the reception of a nib 34 in an aperture 35.

Still referring to FIG. 2, it will be noted that the distal ends 29, 30 of the front wall 28 and rear wall 26 each include through holes 40, 41 respectively for receiving one of the screws 23 (not shown in FIG. 2; see FIGS. 1, 3 and 4). In the embodiment illustrated in FIG. 2, the through hole 40 is configured to receive a flat head screw 23. Due to the incorporation of the locating legs 32 off of the back wall 26 of the tie bar guide 22 and the groove 33 in the frame 11, the tie bar guide 22 can be safely secured to the frame 11 with as few as one screw 23. The use of the locating legs 32 in the groove 33 provides extra support for the tie bar 19 so that only a single screw needs to be used to connect the tie bar guides 22 to a wooden window. However, three screw holes or three matching pairs of through holes 40, 41 are provided as illustrated in FIG. 1.

Turning to FIG. 3, it will be noted that the tie bar guide 22 and tie bar 19 of the present invention are mounted between a window frame 11 and a wood stop 37. Wood stops 37 are used to cover or overlie the hardware assembly for aesthetic reasons and also to provide a protective cover for the hardware assembly. However, as it will be noted from FIG. 3, there is a lack of structural support for the wood stop 37 along the space 38 where the tie bar guides 22 and tie bar 19 is mounted to the frame 11. As a result of this lack of structural support, wood stops can often be bent, cracked or broken along this area. As a remedy for this situation, the inventive tie bar guide 22 includes one or more ribs 38 that extend outward from the front wall 28 and further which engage the inside surface 19 of the wood stop 37. As a result, the plurality of ribs shown at 38 in FIG. 4 provide structural support for the wood stop 37. Thus, the outwardly protruding ribs 38 of the tie bar guide 22 of the present invention helps avoid the cracking and breaking of wood stops 37 that has been a problem in the art.

Also shown in FIG. 3 is the incorporation of a ledge 41 in the window frame 11 for receiving the distal end 30 of the back wall 26 of the tie bar guide 22. The ledge 41 can be used as an alternate groove 33 to facilitate in the proper location and alignment of the tie bar guide 22 and tie bar 19 against the window frame 11. The distal end 30 can be adjusted to provide differential location.

Figure 5:
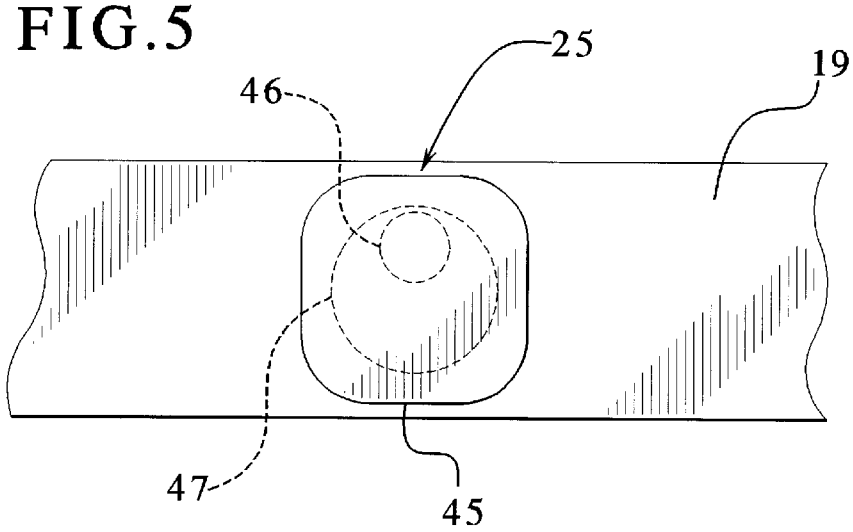
FIG. 5 is a front plan view of a roller made in accordance with the present invention connected to a tie bar.

Turning to FIGS. 1 and 5, the roller 25 includes an outer plate 45 that is connected to a pin 46. The pin 46 is tightly, but pivotally secured to the tie bar 19. The pin 46 extends eccentrically through a cylindrical roller section 47 which engages the keeper 24. See also FIGS. 1 and 4. The roller section 47 is snugly wedged between the outer plate 45 and the tie bar 19 so that application of a significant amount of torque to the outer plate 45 is required to rotate the outer plate 45, pin 46 and roller section 47. Rotation of the outer plate 45, of course, results in an eccentric rotation of the roller 47 about the pin 46 thereby adjusting the position of the roller section 47 with respect to the tie bar 19. By applying torque to the outer plate 45 with a standard hand tool, such as a pair of pliers, the position of the roller 47 with respect to both the tie bar 19 and the keeper 24 can be easily adjusted.

Figure 6:
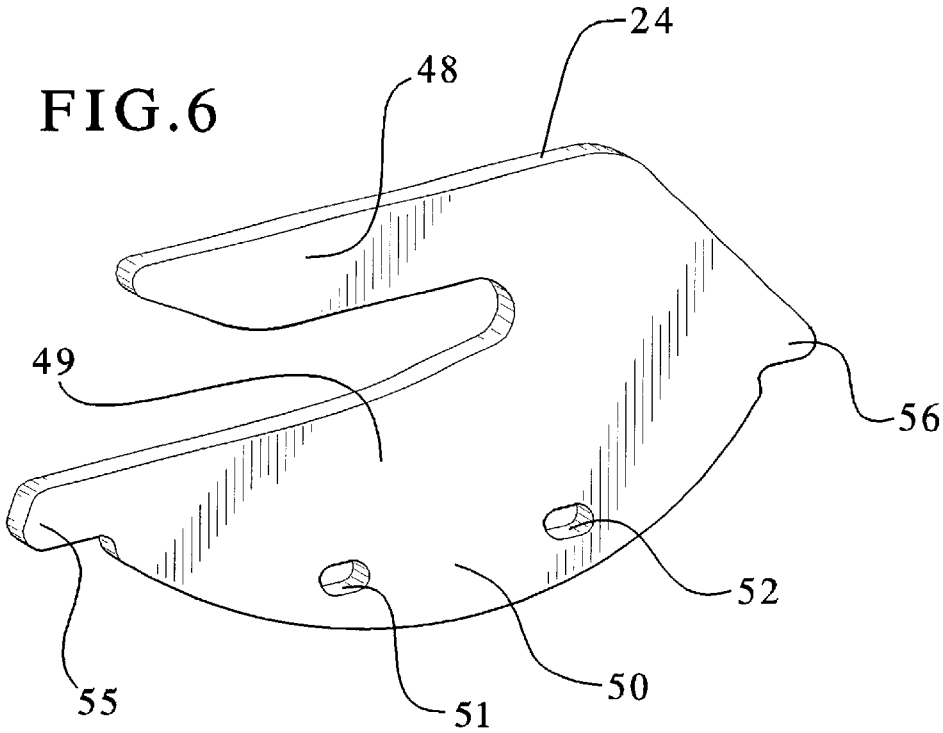
FIG. 6 is a perspective view of a keeper or striker made in accordance with the present invention.

Turning to FIGS. 1 and 6, the striker 24 includes an upper arm 48 that is connected to a base section 49 in a C-shaped configuration as illustrated. The base section 49 is connected to a lower support section 50. The lower support section 50 includes screw holes 51, 52 that extend transversely through the lower support section 50. As shown in FIG. 1, the lower support section 50 is accommodated in a slot 53 disposed in the sash 54. Thus, the slot or groove 53 is routed at the factory and the location of the keeper 24 is predetermined and not based upon an assembler's physical measurement. The base portion 49 may also include a front extension 55 and a rear extension 56 to provide stability for the keeper 24 and to seal any gaps that may exist between the lower support portion 50 and the slot or groove 53.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An improved casement window comprising:

a flat tie bar, at least two tie bar guides through which the tie bar slidably extends, a window frame comprising a surface that extends parallel to the tie bar, the window frame comprising an elongated groove in said surface that extends perpendicular to the flat tie bar, wherein each tie bar guide comprises a body and at least one locating leg extending outward from the body, said at least one locating leg being received in the groove of the frame.

2. The casement window of claim 1 wherein each tie bar guide further comprises a plurality of spaced apart locating legs all of which are received in the groove of the frame.

3. The casement window of claim 1 wherein each tie bar guide comprises at least two locating legs with a through-hole disposed therebetween for receiving a screw used to secure the tie bar guides to the frame.

4. The casement window of claim 1 wherein each tie bar guide further comprises a back wall that abuttingly engages the frame, the back wall being connected to a U-shaped top which connects the back wall to a front wall, the front and back walls each comprise bottom ends that abuttingly engage each other, the tie bar being slidably received in an aperture formed by the front wall, the rear wall, the U-shaped top and the abutting bottom ends of the front and rear walls, said at least one locating leg extending outward from the rear wall of the tie bar guide into the groove of the frame.

5. The casement window of claim 4 wherein each tie bar guide further comprises at least one rib that extends outward from the front wall, and the casement window further comprising a wood stop, each rib of each tie bar guide abuttingly engaging the wood stop.

6. The casement window of claim 5 wherein each tie bar guide further comprises a plurality of ribs that extend outward from the front wall.

7. The casement window of claim 4 wherein the bottom ends of the front and rear walls of each tie bar guide comprise a through-hole, the through-holes of the front and rear walls being in alignment for receiving a screw for securing the tie bar guide to the frame.

8. The casement window of claim 4 wherein the bottom end of each back wall further comprises a tapered distal end and the window frame comprises a ledge that engages and supports the tapered distal ends, the distal ends each having a length that can be shortened to adjust the position of the tie bar guides with respect to the frame.

9. The casement window of claim 1 wherein the tie bar comprises an aperture, and each tie bar guide comprises a nib that is received in the aperture, whereby, after each tie bar guide is secured to the frame, an initial sliding movement of the tie bar through the tie bar guides will result in the nibs being sheared off of the tie bar guides.

10. An improved casement window comprising:

a flat tie bar, at least two tie bar guides through which the tie bar slidably extends, a window frame to which the tie bar guide is secured, a wood stop which overlies the tie bar, tie bar guides and frame in a parallel relationship to the tie bar and frame, wherein each tie bar guide comprises a back wall that abuttingly engages the frame, the back wall being connected to a U-shaped top which connects the back wall to a front wall, the front and back walls each comprise bottom ends that abuttingly engage each other, the tie bar being slidably received in an aperture formed by the front wall, the rear wall, the U-shaped top and the abutting bottom ends of the front and rear walls, each tie bar guide further comprising at least one rib that extends outward from the front wall and that abuttingly engages the wood stop.

11. The casement window of claim 10 wherein each tie bar guide further comprises a plurality of ribs that extend outward from the front wall.

12. The casement window of claim 10 wherein the bottom ends of the front and rear walls of each tie bar guide comprise a through-hole, the through-holes of the front and rear walls of each tie bar guide being in alignment for receiving a screw for securing the tie bar guides to the frame.

13. The casement window of claim 10 wherein the tie bar comprises an aperture, and each tie bar guide comprises a nib that is received in the aperture, whereby, after the tie bar guides are secured to the frame, an initial sliding movement of the tie bar through the tie bar guides will result in the nibs being sheared off of the tie bar guides.

14. The casement window of claim 10 wherein the back wall of each tie bar is connected to at least one locating leg extending outward from the back wall, the frame further comprising a groove that extends along the frame and perpendicular to the tie bar, said at least one locating leg of each tie bar being received in the groove of the frame.

15. The casement window of claim 14 wherein the back wall of the tie bar guide is connected to a plurality of spaced apart locating legs all of which are received in the groove of the frame.

16. The casement window of claim 15 wherein the groove is parallel to the tie bar.

17. The casement window of claim 15 wherein the tie bar guide comprises at least two locating legs with a through-hole disposed therebetween for receiving a screw used to secure the tie bar guide to the frame.

18. The casement window of claim 10 wherein the bottom end of each back wall further comprises a tapered distal end and the window frame comprises a ledge that engages and supports the tapered distal ends, the distal ends each having a length that can be shortened to adjust the position of the tie bar guides with respect to the frame.

19. An improved casement window comprising:

a tie bar comprising an aperture, at least two tie bar guides through which the tie bar slidably extends, each tie bar guide comprising a nib that is received in the aperture, whereby an initial sliding movement of the tie bar through the tie bar guides as the tie bar guides are fixed in place will result in the nibs being sheared off of the tie bar guides.

20. The casement window of claim 19 further comprising:

a window frame comprising an elongated groove that extends parallel to the tie bar, and wherein the tic bar guides each comprise a body and at least one locating leg extending outward from the body, each of said locating legs being received in the groove of the frame, and the tie bar guides being fixedly connected to the frame.

21. The casement window of claim 20 wherein each tie bar guide further comprises a plurality of spaced apart locating legs all of which are received in the groove of the frame.

22. The casement window of claim 20 wherein the groove is parallel to the tie bar.

23. The casement window of claim 20 wherein each tie bar guide comprises at least two locating legs with a through-hole disposed therebetween for receiving a screw used to secure the tie bar guide to the frame.

24. The casement window of claim 20 wherein the casement window further comprises a wood stop that overlies the tie bar, the tie bar guide and the frame, and each tie bar guide further comprises a back wall that abuttingly engages the frame, the back wall being connected to a U-shaped top which connects the back wall to a front wall, the front and back walls each comprise bottom ends that abuttingly engage each other, the tie bar being slidably received in an aperture formed by the front wall, the rear wall, the U-shaped top and the abutting bottom ends of the front and rear walls, said at least one locating leg extending outward from the rear wall of the tie bar guide into the groove of the frame, and said at least one rib that extends outward from the front wall, and said at least one rib abuttingly engages the wood stop.

25. The casement window of claim 24 wherein the bottom ends of the front and rear walls each comprise a through-hole, the through-holes of the front and rear wall being in alignment for receiving a screw for securing the tie bar guide to the frame.

26. An improved casement window comprising:

a flat tie bar comprising a roller, at least two tie bar guides through which the tie bar slidably extends, the tie bar guides being connected to a window frame, a window sash comprising a slot that extends parallel to the flat tie bar, a flat keeper comprising an upper arm connected to a base and the base being connected to a lower support portion so that the base is disposed between the lower support portion and the upper arm, the lower support portion comprising two holes that extend transversely through the lower support portion and transversely to the groove and the tie bar, the lower portion of the keeper being disposed in the slot of the sash with the base and upper arm extending outward from the slot and the sash so that the flat keeper is disposed parallel to but offset from the flat tie bar and so that the roller connected to the tie bar can be received between the upper arm and the base of the keeper, the keeper being secured to the sash by fasteners that extend through the holes of the lower support section at the keeper and the slot of the sash.

27. The casement window of claim 26 wherein the base comprises a forward projecting portion and a rearward projecting portion that extend forward of and rearward of the slot of the window sash.

28. An improved striker for locking casement windows comprising:

a flat plate comprising an upper arm connected to a base, the base being connected to a lower support portion so that the base is disposed between the lower support portion and the upper arm, the lower support portion comprising two holes that extend transversely through the lower support portion and transversely to the upper arm, the base portion further comprising a forward projecting portion and a rearward projecting portion that extend forward and rearward of the lower support portion respectively.

29. An improved casement window comprising:

a tie bar comprising a roller, at least two tie bar guides through which the tie bar slidably extends, a window frame to which the tie bar guide is secured, a window sash connected to a keeper for engaging the roller, the roller comprising a pin pivotally connected to the tie bar at one end and fixedly connected to an end plate at another end, the pin eccentrically passing through a roller section.

30. An improved tie bar for a casement window comprising:

a tie bar, the tie bar being pivotally connected to a pin that extends transversely outward from the tie bar, one end of the pin being pivotally connected to the tie bar and another end of the pin being fixedly connected to an outer plate, the pin extending eccentrically through a roller section, the roller section being trapped between the outer plate and the tie bar.

* * * * *